United States Patent [19]

Baus

[11] Patent Number: 4,807,312

[45] Date of Patent: Feb. 28, 1989

[54] PARTITION, MORE PARTICULARLY FOR CORNER-SHOWERS

[76] Inventor: Heinz G. Baus, Wartbodenstrasse 35, CH-3626 Hünibach-Thun, Switzerland

[21] Appl. No.: 16,634

[22] Filed: Feb. 19, 1987

[30] Foreign Application Priority Data

Feb. 22, 1986 [DE] Fed. Rep. of Germany ..... 3605770

[51] Int. Cl.[4] ..... A47K 3/22

[52] U.S. Cl. ..... 4/607; 4/614; 49/40; 49/370; 52/71; 52/457; 160/203; 160/217; 160/195; 312/332; 312/138 R; 312/238; 211/162

[58] Field of Search ..... 4/607, 614, 612, 609, 4/596, 599, 604; 312/332, 138 R, 238; 49/371, 40, 370, 41; 160/203, 217, 195; 211/162; 52/71, 457

[56] References Cited

U.S. PATENT DOCUMENTS

| | | | |
|---|---|---|---|
| 1,719,357 | 7/1929 | Binns | 49/40 |
| 2,028,627 | 1/1936 | Sherron | 49/40 |
| 2,985,491 | 5/1961 | Hayes | 312/332 |
| 3,995,563 | 12/1976 | Blunden | 49/370 |
| 4,653,127 | 3/1987 | Baus | 4/607 |

FOREIGN PATENT DOCUMENTS

| | | | |
|---|---|---|---|
| 733575 | 5/1969 | Belgium . | |
| 644661 | 5/1937 | Fed. Rep. of Germany . | |
| 2604376 | 8/1977 | Fed. Rep. of Germany | 4/607 |
| 3209768 | 9/1983 | Fed. Rep. of Germany | 4/607 |
| 3309606 | 9/1984 | Fed. Rep. of Germany . | |
| 8416939 | 1/1985 | Fed. Rep. of Germany . | |
| 8512641 | 8/1985 | Fed. Rep. of Germany . | |
| 3429053 | 2/1986 | Fed. Rep. of Germany . | |
| 751229 | 2/1933 | France . | |
| 300295 | 9/1932 | Italy | 49/40 |
| 22758 | 11/1893 | United Kingdom | 49/41 |

*Primary Examiner*—Henry J. Recla

*Attorney, Agent, or Firm*—Foley & Lardner, Schwartz, Jeffery, Schwaab, Mack, Blumenthal & Evans

[57] ABSTRACT

A partition, more particularly for a corner-shower, with a rounded entrance area, contains door-elements by means of which the entrance-area may be closed off or opened. The door-elements are arranged displaceably in guide-rails which are curved in the entrance area and are connected to at least one wall-element. It should be possible to produce a partition of this kind inexpensively and to obtain reliable guidance and accurate alignment of the door-elements with as few components as possible. The door-elements are curved to match the guide-rails and the guide-elements of each door-element is arranged at a predetermined distance from the longitudinal edges. A total of two door-elements is provided and these are curved over an angular range of approximately 45°. They are adjustable in height by means of at least one guide-element, more particularly an eccentric pin.

19 Claims, 4 Drawing Sheets

PARTITION, MORE PARTICULARLY FOR CORNER-SHOWERS

BACKGROUND OF THE INVENTION

1. Field of the Invention

The present invention relates to a partition, more particularly for a corner-shower, of the type comprising a rounded entrance-area, door-elements by means of which the entrance-area can be closed off or opened, a guide-rail which is curved in the entrance-area and in which the door-elements are displaceable by means of guide-elements, and two wall-elements which are each arranged at the side of the entrance-area, and to which the guide-rail is connected.

2. Description of the Prior Art

A partition of this kind, comprising four door-elements in all, is known from German OS No. 33 09 606. Two of the door-elements are hinged to each other at their longitudinal edges and the two pairs of door-elements thus formed are displaceable in relation to each other in the guide-rail, for the purpose of closing off or opening the entrance-area. Each door-element is mounted displaceably in the guide-rail by means of separate guide-elements, and is suspended. Each of the individual door-elements comprises a frame made out of a total of four profiled rails, production and assembly of these profiled rails, and of the frame, for the purpose of accommodating transparent sheets or the like, being relatively costly. The hinging together of the pairs of door-elements is also costly, since flexible strips or the like must be secured to the longitudinal edges of the profiled rails in order to achieve reliable sealing. In order to ensure that the doors run reliably and smoothly, all of the guide-elements must be mounted and adjusted very accurately since otherwise the guide-elements may jam in the guide-rail. Assembly costs are thus by no means inconsiderable.

German GM No. 85 12 641 discloses a shower-stall consisting of prefabricated substantially cylindrical parts arranged vertically one above the other. In the entrance-area an opening is kept free and a rotary door is associated therewith, the rotary door being arranged coaxially with the shower-stall and in the interior thereof. The difficulties arising in corner-showers with flat and straight parts, in connection with the guide-elements and the sealing of the doors, do not occur in this case. This known shower-stall is a prefabricated unit and cannot be used as a corner-shower in conjunction with a corresponding shower tub.

German GW No. 84 16 939 describes a shower-stall containing a square base plate and circular guide-rails. This unit has a wall-element in the form of a moulded part which is secured to a straight wall, not in the corner of a shower. It requires a considerable amount of space and large doors which must extend over an angular range of at least 120°. This results in corresponding production costs, together with high inventory and transportation costs.

Also known from German PS No. 34 29 053 is a shower separation, the doors of which are displaceable in a horizontal guide-rail. The door-guide elements may be adjusted in height in relation to the guide-rail, in order to ensure accurate vertical suspension of the door-elements. Guide-rollers are arranged on eccentric pins which may be rotated about their axes for the purpose of altering the height of guide-rollers.

OBJECTS OF THE INVENTION

Based upon the foregoing, it is an object of the invention to develop the partition inexpensively, improving production costs by reducing the number of parts and thus, in turn, reducing assembly costs. Simple and reliable alignment and highly accurate vertical suspension of the door-elements is to be obtained with low assembly costs, and it is to be possible even for unskilled labour to carry out subsequent adjustments quite simply. The partition is also to be of an attractive design, great reliability and excellent stability is to be secured with few components. With few components and low production-costs, it is to be possible to achieve long service-life. With the door-elements in the closed condition, any escape of water is to be reliably prevented.

SUMMARY OF THE INVENTION

According to the present invention, there is provided a partition, more particularly for a corner-shower, comprising a rounded entrance-area, door-elements by means of which said entrance-area can be closed off or opened, a guide-rail which is curved in said entrance-area and in which said door-elements are displaceable by means of guide-elements, and two wall-elements which are each arranged at the side of the entrance-area, and to which said guide-rail is connected, wherein:

the two door-elements are curved to match the guide-rail and extend over an angular range of between 40° and 50°, the guide-elements of each door-element are arranged at a predetermined distance from the respective longitudinal edges of the door-element, at least one of said guide-elements is an eccentric pin for adjustsing the height of the door-element, each of said two wall-elements comprises a vertical side-profile, the two vertical side (or lateral) profiles of the wall-elements defining said entrance-area, each vertical side profile comprising a web against which a sealing element of the corresponding door-element bears.

The partition according to the invention is noted for its functional and simple design which ensures that no spray shall escape from the entrance-area. The partition has relatively few components and an attractive design is obtained by curving the door-elements in accordance with the guide-rail. The guide-elements are arranged at a pre-determined distance from the longitudinal edges of the respective door-element in such a manner that the door-element and the profiled rails thereof do not make contact with the guide-rail, although the profiled rails come as close as possible to the guide-rails. When looking at the partition from the outside, the guide-rail, which is made in one piece, is arranged behind the stationary wall element and is connected thereto so that, in the open condition, the curved door-element is also located behind the wall-element. As the guide-elements are at the same distance from the respective longitudinal edge, the door-element is located symmetrically behind the stationary wall-element.

Only a single guide-element with an eccentric pin, or some comparable height-adjusting device, is preferably provided for each door-element. The other guide-element is connected rigidly to the door-element, thus ensuring a simple design and simple alignment of the door-element. Since only one guide-element per door-element is adjustable in height, vertical alignment of the door element can also be carried out quite easily by unskilled labour.

Designing the curved doors as segments extending over an angular range of preferably 45° means that the necessary transporting volume is not excessive, while handling during assembly is relatively simple.

Preferably, webs are arranged at each side of the entrance-area, on the lateral profiles, and because of this, the sealing-elements at the outer edges of the two door-elements, which are adapted to pivot open in relation to each other, ensure reliable sealing in the closed condition. The webs are preferably of the same width as the guide-rails and the respective sealing element engages behind the rear side of the webs. This provides a larger overlap-area and improves the sealing.

In a preferred embodiment, each door-element comprises an upper horizontal profiled rail containing a hollow chamber or a cavity running in the longitudinal direction, into which the guide-elements are inserted.

Preferably, each of the two door-elements comprises a single stationary guide-element and a single guide-element which is adjustable in height, both the stationary guide-element and the guide-element adjustable in height being pushed into the profiled rails from the ends or the longitudinal edges, and being anchored there by means of screws or the like. Thus inexpensive assembly may be carried out with little handling.

Preferably, the eccentric pin has an outer surface which comprises teeth and which serves as a locking surface upon which an adjustable locking arm or the like lies. This is a simple way of preventing the eccentric pin from rotating and thus locking the height adjustment. On the other hand, the eccentric pin can be rotated, with the use of very little force, in order to vary the height adjustment.

In order to obtain a simple but stable design of guide-element, according to a preferred embodiment the elements are pivoted towards the central plane, out of the relevant radial plane, through a predetermined small angle, preferably somewhere between 3° and 7°. Even with a fixed arrangement of the guide-elements, i.e. with guide-elements which do not rotate about a vertical axis, this ensures that the doors are easily moved. The doors may be moved smoothly in the profiled rail, both in the straight and in the curved areas, with the use of little force, and excessive frictional force, or even jamming, is reliably prevented.

BRIEF DESCRIPTION OF THE DRAWINGS

Preferred embodiments of the present invention are described hereinafter in greater detail, as examples without limitative manner, in conjunction with attached drawings hereto, wherein.

DESCRIPTION OF AN EXEMPLARY EMBODIMENT

Figure 1:
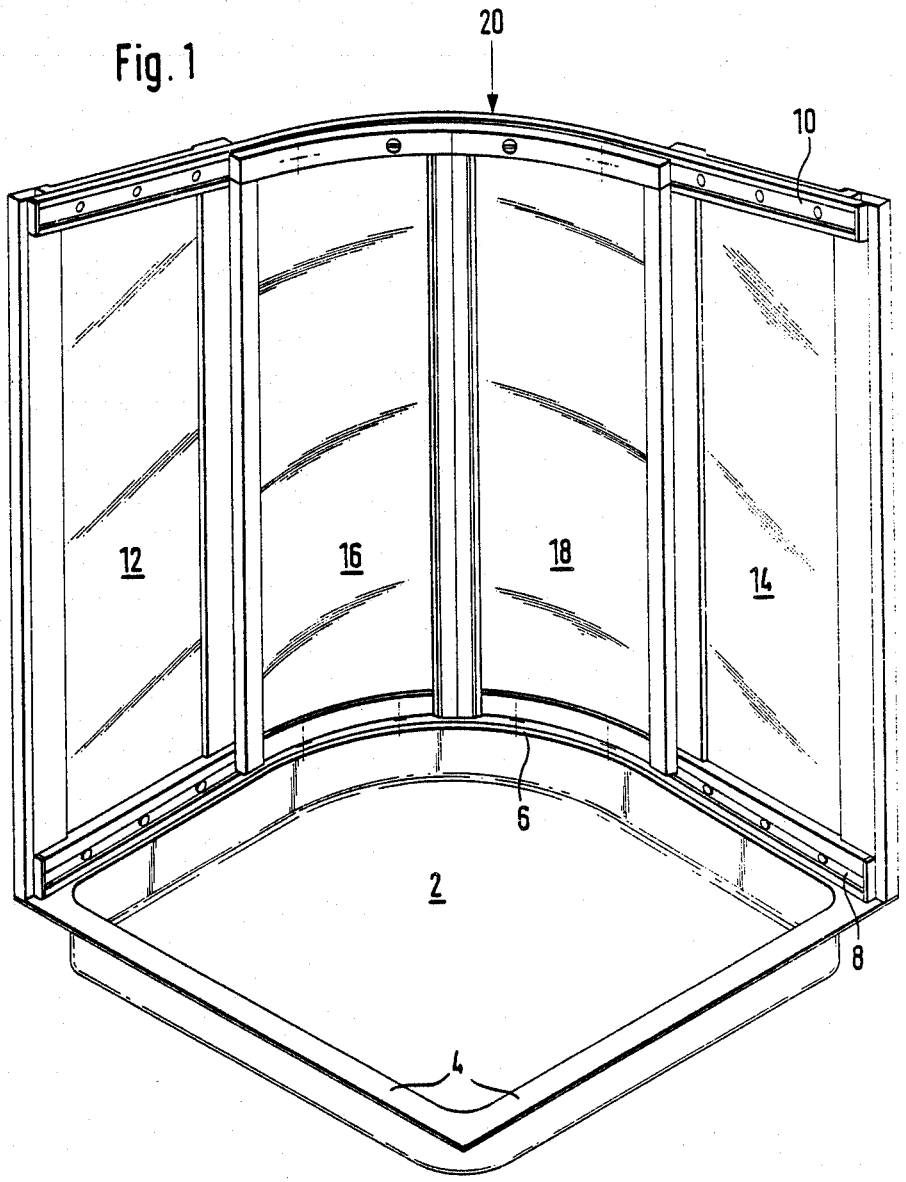
FIG. 1 is a perspective view of the partition from the interior, the entrance-area being closed off by two curved door-elements.

FIG. 1 shows a shower-tub 2 having two rear edges 4 and a curved front edge 6. Arranged upon curved edge 6 is a partition with a lower guide-rail 8 and an upper guide-rail 10. The partition contains two flat, stationary, lateral wall-element 12,14 which are connected to guide-rails 8,10 by means of screws or the like. The guide-rails are arranged on the rear sides of flat wall-elements 12,14 i.e. to a person located outside the shower-tub, they are arranged behind wall-elements 12, 14. Two curved door-elements 16,18 are suspended from, and are displaceable along, upper guide-rail 10 by guide-means which will be described hereinafter. Wall-elements 12,14, and also door-elements 16,18, comprise frames built up from profiled rails, a transparent sheet of plastic or glass being inserted into these frames in the usual manner. Door-elements 16,18 may be pushed aside along the guide-rails behind flat wall-elements 12,14, thus leaving entrance-area 20 free.

Figure 2:
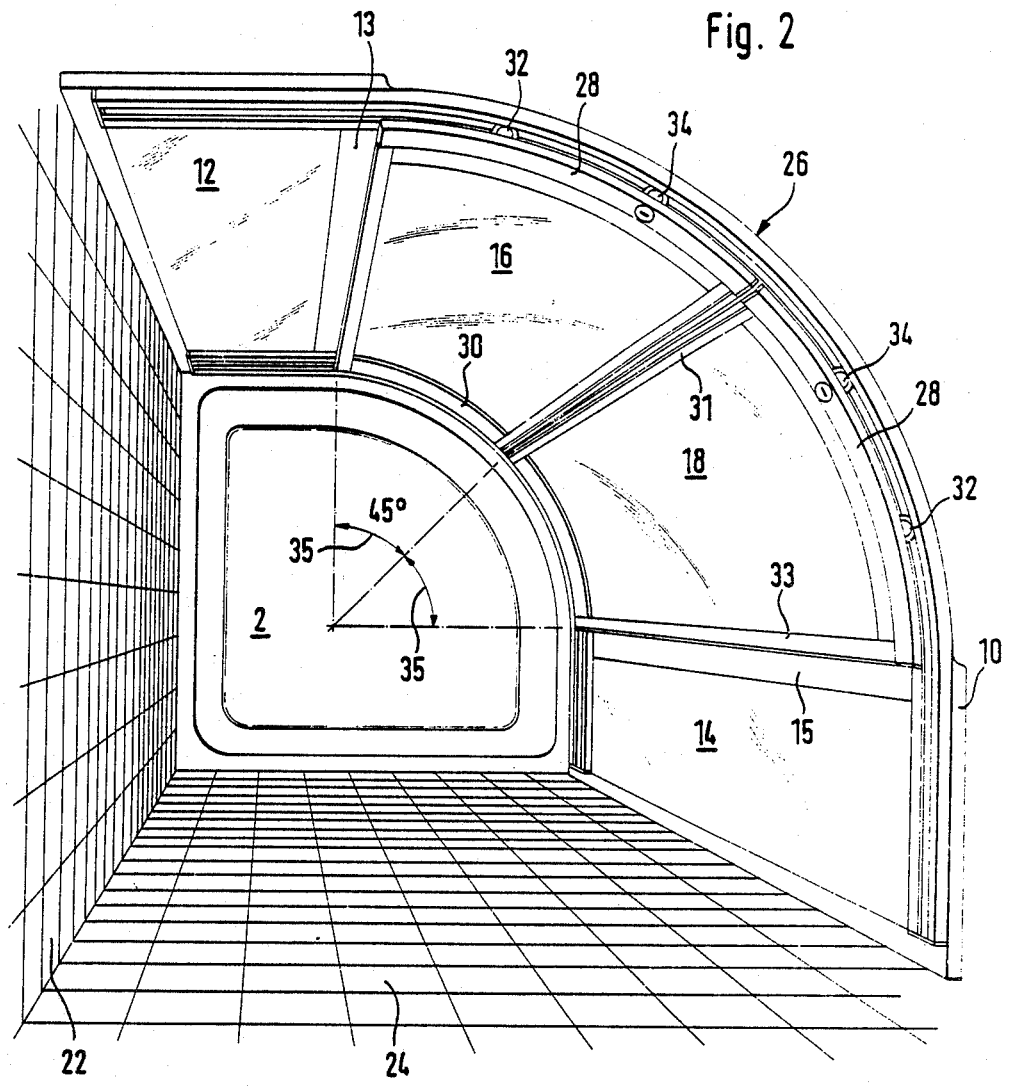
FIG. 2 is a view from above of the partition according to FIG. 1 incorporated into a corner of a room.

FIG. 2 is a view from above of the partition and of shower-tub 2 which is built into the corner between two walls 22,24 of a room. The curved design of door-elements 16,18, matching curved area 26 of upper guide-rail 10, may be seen here clearly, the lower guide-rail also has a curved area and horizontal upper and lower profiled rails 28,30 of the door-elements are curved accordingly. Vertical profiled rails 31,33 are straight. In the vicinity of flat wall-elements 12,14, the guide-rails are straight. The door-elements 16,18 are each suspended displaceably from upper guide-rail 10 by means of two guide-elements 32,34, guide-element 32 being stationary and guide-element 34 being adjustable. Wall-elements 12,14 comprise vertical side-profiles 13,15 which define the entrance-area. Each of door-elements 16,18 is curved over an angular range 35 of approximately 45°. Profiled rails 28,30 are arranged coaxially with upper and lower guide rails 10 and 8, i.e. behind the guide-rails 8,10 as seen from the outside in the direction of shower-tub 2.

Figure 3:
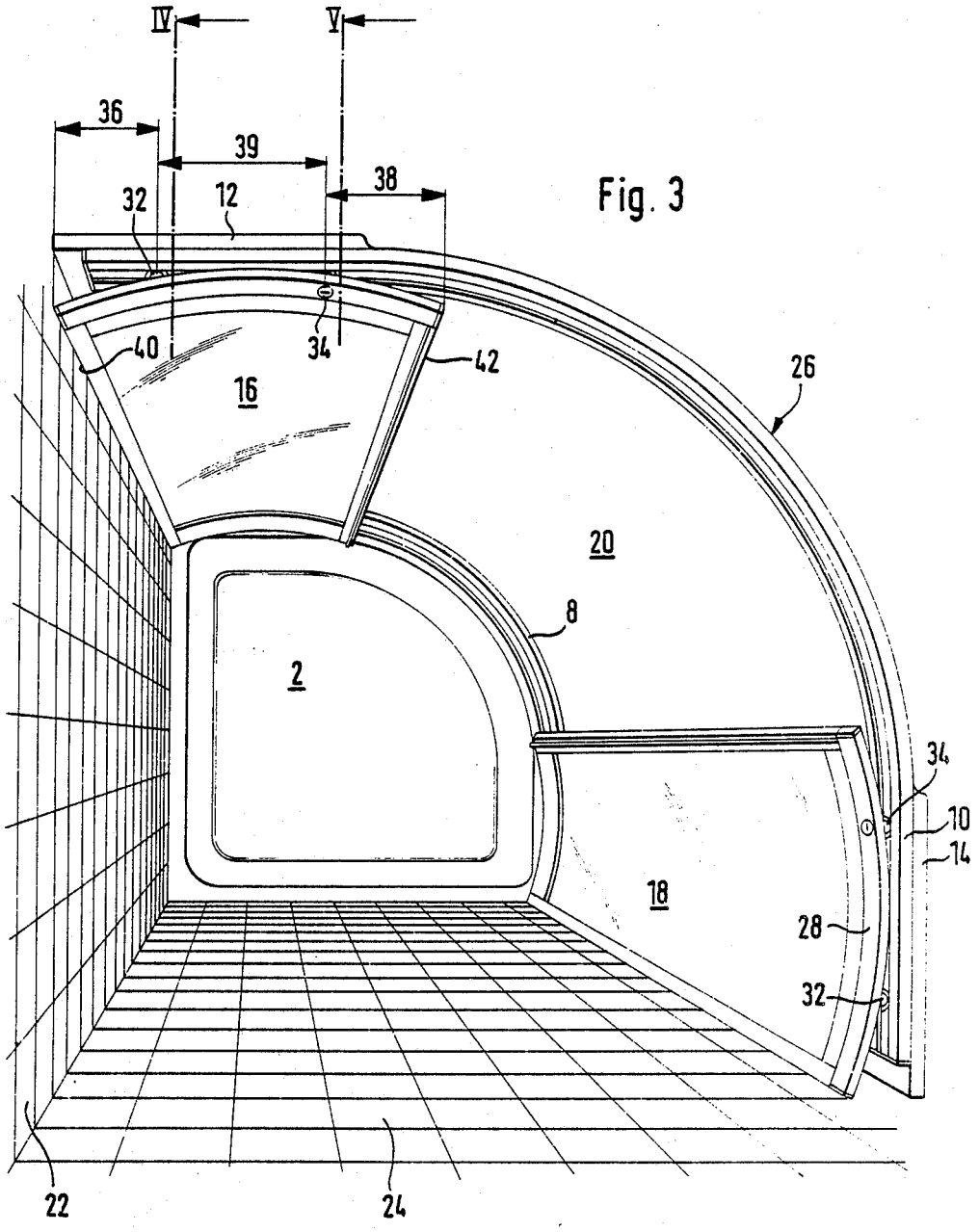
FIG. 3 is a view similar that in FIG. 2, but with the door-elements open.

FIG. 3 is a view similar to that in FIG. 2, but with door-elements 16,18 pushed behind stationary wall-elements 12,14 in order to leave an entrance-area 20 free. Each of guide-elements 32,34 is arranged at a distance 36,38 from longitudinal edges 40,42 in such a manner that upper profiled rail 28 is at a small enough distance from the straight area of upper guide-rail 10 to avoid contact. The same applies to the lower profiled rail and the guide- or sliding-elements arranged there. Distance 39 between guide-elements 32,34 is larger by a factor of less than 2, preferably between 1.4 and 1.6, than the above-mentioned distances 36,38. On the one hand, this ensures stable suspension and, on the other hand, the free length of the guide-elements and the sliding elements can be kept small.

Figure 4:
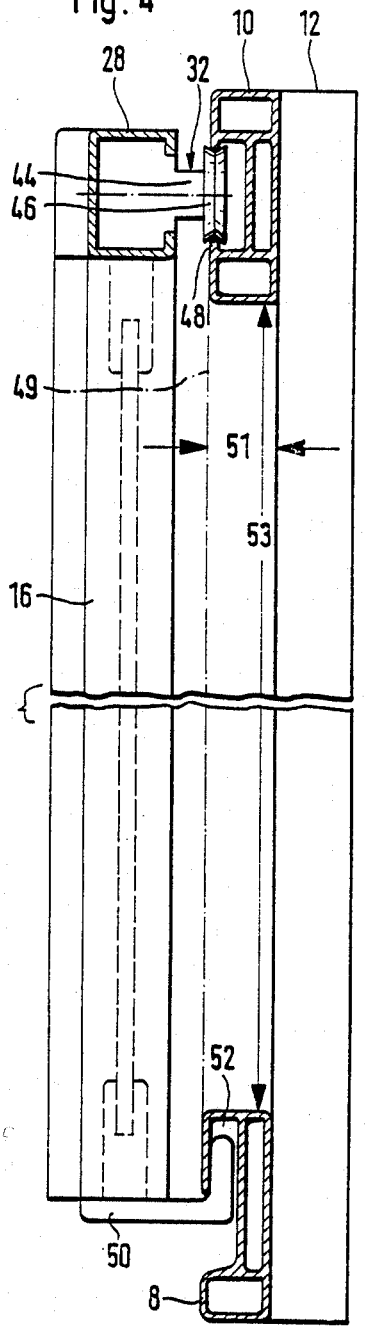
FIG. 4, 5 are sections along lines IV and V, respectively, in FIG. 3.

FIG. 4 shows a section along line IV of FIG. 3, the wall-element 12 being shown merely diagrammatically. Upper profiled rail 28 comprises an internal cavity into which the stationary guide-element 32 is pushed and is secured with a screw. Guide-element 32 comprises a guide-roller 46 which is carried upon a rigid arm 44 and which rotates upon a ball-bearing, the guide-roller 46 running on a track 48 in upper guide-rail 10. Guide-rail 10 is in the form of a hollow-chamber profile and the corresponding guide-elements of the other door-element also run in the same guide-track 48. Located on the underside of door-element 16 is another guide-element in the form of a sliding element 50. The latter engages from below in a guide-track 52 of lower guide-rail 8. Sliding element 50 is located vertically below guide-element 32. The dotted line represents a web 49 on the vertical side-profile of wall-element 12. Web 49 lies in front of the plane of the drawing and is of a width 51 which is substantially equal to the width of guide-rail 8 or 10. The height 53 of web 49 corresponds to the distance between guide rails 8, 10. This web serves to close off the free space between guide-rails 8,10 on the entrance side. The door-element comprises a sealing element which will be described hereinafter.

Figure 5:
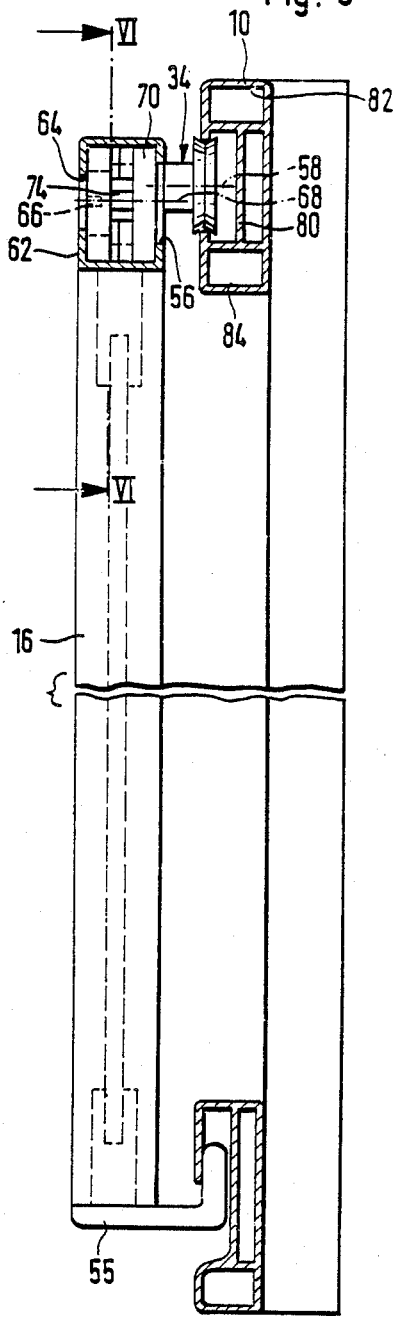

FIG. 5 shows a section similar to that in FIG. 4 but in the vicinity of the adjustable guide-element 34. For the sake of clarity, the curved design of door-element 16 is not shown. Guide element 34 contains an eccentric pin 54 which is inserted, in turn, into the cavity in upper profiled rail 28, from the longitudinal edge of the door element. Upper profiled rail 28 comprises a longitudinal groove 56 extending over the entire length, so that eccentric pin 54 can be pushed into the said cavity accordingly. Eccentric pin 54 contains an eccentrically arranged stud 58 upon which a guide-roller 60 rotates upon a ball-bearing. Profiled rail 28 carries, on its inside 62, a bore 64 through which a suitable tool, more particularly a screwdriver, may be inserted into a slot 66. Rotating eccentric pin 54 about its central axis 68 varies the vertical distance between stud 58 and the central axis. It also varies the vertical alignment between door-element 16 and guide-rail 10. If FIGS. 4 and 5 are compared, it will be seen that in FIG. 5 door-element 16 hangs somewhat lower down. On the whole, therefore, door-element 16 would hang correspondingly inclined in the partition. It will be seen, therefore, that if upper guide-rail 10 is not accurately aligned horizontally, exact vertical alignment of the door-element may be predetermined by adjustment of guide-element 34.

Located in the interior of profiled rail 28 is an attachment-part 70 by means of which the location of eccentric pin 54 is carried out both in the longitudinal direction of profiled rail 28 and in relation to the rotational position thereof about axis 68. Upper guide-rail 10 exhibits, in the vicinity of guide-track 48, in the middle, a vertical web 80 which connects two box-profile parts 82, 84 together, thus achieving considerable stiffening of profiled rail 10. Like lower-guide rail 8, upper-guide rail 10 is made relatively narrow in the direction at right angles to guide-track 48. The vertical height is at least twice the horizontal width of the two guide-rails 8,10. These guide-rollers may therefore be curved in the manner explained at low cost. A further sliding element 55, corresponding to the sliding element 50 mentioned above, is arranged below guide-element 34. These two sliding elements 50,55, are at the same distance from each other, and from the longitudinal edges, as the guide-elements on upper profiled rail 28.

Figure 6:
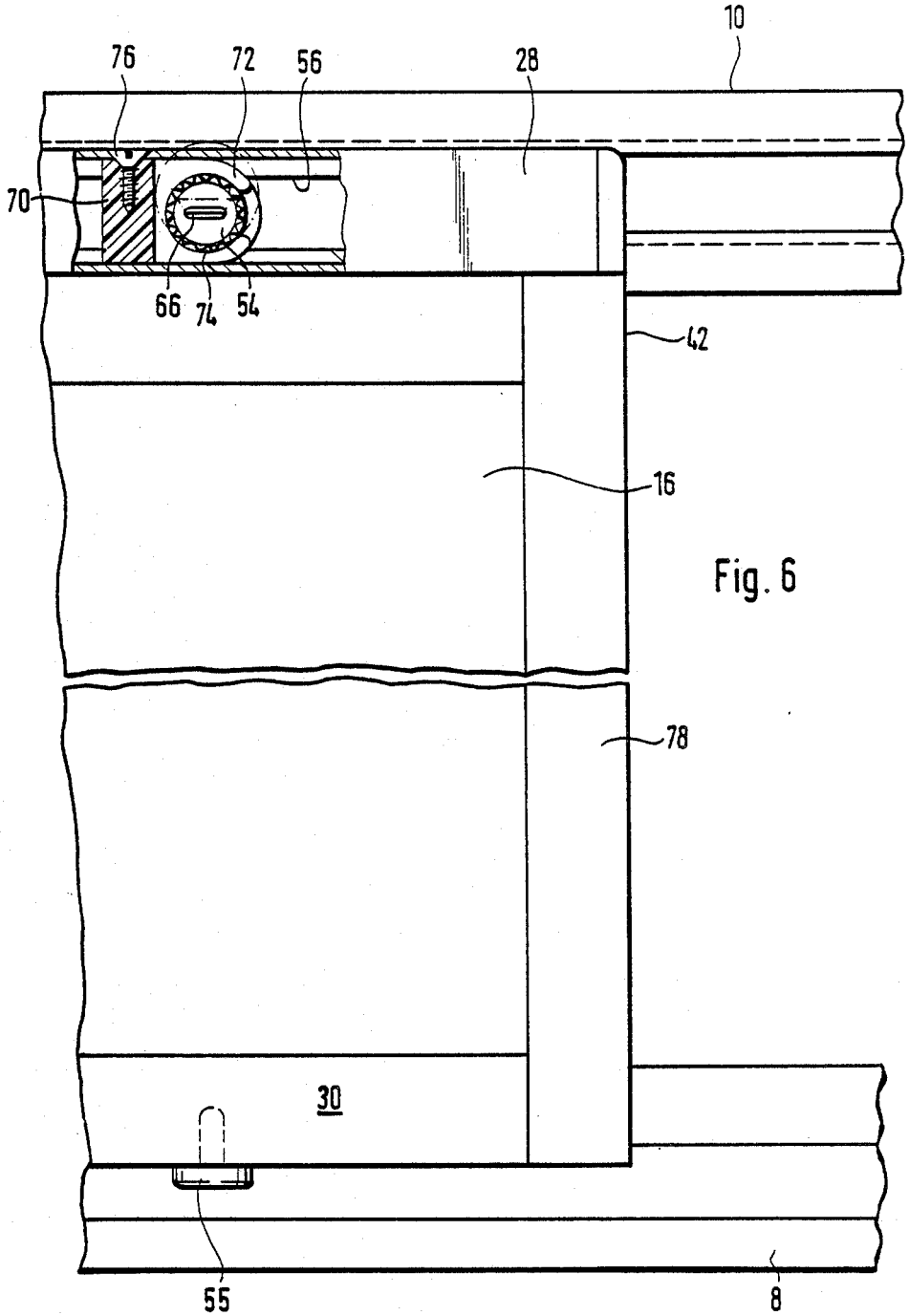
FIG. 6 is a view of a door-element shown partly in section along line VI in FIG. 5.

In FIG. 6 profiled rail 28 is partly cut away to show longitudinal groove 56 on the side of profiled rail 28 facing guide-rail 10. Attachment part 70 contains two locking arms 72 which engage around teeth or locking grooves 74 formed on the outer surface of eccentric pin 54. Locking arms 72 comprise internally corresponding teeth or the like with engage with the teeth or locking arms 74 and lock the eccentric pin in the relevant rotational position. Attachment-part 70 is made of a suitable resilient, flexible material, especially plastic. If a screwdriver is inserted into slot 66, the eccentric pin may be rotated in order to adjust the height of door-element 16. The locking arms, locking grooves and elasticity are matched in such a manner as to ensure reliable locking without requiring too much force in making adjustments. Attachment-part 70 is secured to profiled rail 28 by means of a screw 76. Before assembly, the attachment-part 70, with its locking arms 72, is pushed onto the eccentric pin in the direction of the central axis, i.e. at right angles to the plane of the drawing. The attachment-part 70 and eccentric pin 54, are then pushed jointly, from long side 78, into the cavity and are secured in the manner shown by means of screw 76. This is carried out prior to assembly with vertical profiled rail 80 of the frame of door-element 16. The attachment 70 part thus provides locking along profiled rail 28 and also prevents the eccentric pin from rotating. Sliding element 55, arranged on lower profiled rail 30, is located vertically below eccentric pin 54 and is spaced as far from longitudinal edge 42 as upper adjustable guide-element 34.

Figure 7:
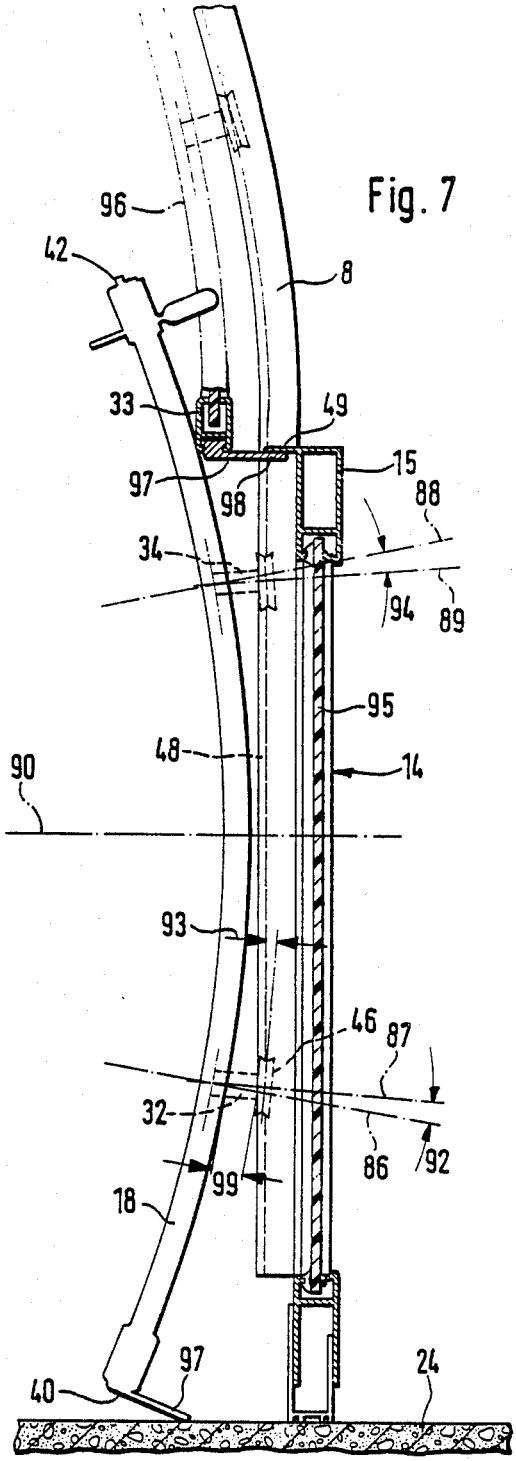
FIG. 7 is a view from above of a curved door-element which, according to FIG. 3, is pushed behind the stationary wall-element, shown as a section in a horizontal plane.

FIG. 7 is a view, to an enlarged scale, of door-element 18 in a position corresponding to that of FIG. 3. In relation to radial plane 86,88, guide-elements 32,34 are offset at an angle 92,94, particularly between 3° and 7° and preferably approximately 5°, towards central plane 90 of door-element 18. Axes 87,89 of rotation of guide-rollers 46,47 are inclined accordingly towards central plane 90 according to the invention. Guide-track 48 of the upper guide-rail 10, which is located in front of the plane of the drawing, is shown by a broken line. Guide-roller 46 is at an angle 93 to guide-track 48. Were it not for the oblique setting corresponding to angle 92, angle 93 between guide-roller 46 and guide-track 48 would be considerably greater, as would also be the resistance to rolling in the straight section of the guide-rail. On the other hand, without the pivoting, according to the invention, of guide-rollers 46,47, upon alignment of axes of rotation 87,89 in the radial planes, the resistance to rolling in the curved section of the guide-rail would be considerably lower. In other words, without the pivoting, according to the invention, of the guide-rollers 46,47, if the door-element were to be pushed from the straight section to the curved section, the resistance to rolling would become increasingly small in the course of this movement. During closing of the door-element, the user would initially have to use a large amount of force. In the curved section, the doors would then roll very easily and they would meet in the middle with considerable force, resulting in heavy loading and considerable wear. As a result of the oblique setting of the guide-elements 46,47, the resistance of the door-elements to rolling is largely the same both in the straight and in the curved sections of the guide-rail, and this is accomplished at low structural cost. Because of the distances, explained hereinbefore, between guide-elements 32,34 and longitudinal edges 40,42, and between each other, length 99 can be kept relatively short and, at the same time, stable suspension is achieved. If guide-elements 32,34 were arranged closer to central plane 90, the guide-elements could indeed be made shorter, but stability in the suspension of the door-element would no longer be assured. If the distance between guide elements 32,34 were greater, the guide-elements would have to be made longer. In the closed condition, the door-element would then be too far from the guide-rail and additional measurements would have to be taken to prevent water from spraying out in the vicinity of the lower guide-rail. The given arrangement is a satisfactory, low-cost compromise.

Vertical side-profile 15 and plastic plate 95 are easy to recognize from stationary wall-element 14. Web 49 of the side-profile is of substantially the same width as guide-rail 8. In the upper part of FIG. 7 broken line 96 indicates door-element 18 in the closed position according to FIG. 2. Vertical profiled rail 33 is shown in section, as is a sealing element 97. The latter is secured in an undercut longitudinal groove in vertical profiled rail 33 and has an arm 98 which bears, with an overlap, against the rear side of web 49. According to the invention, arm 98 engages over a substantial portion of upper profiled rail 8, so that this area can be reliably sealed. As may be seen, the door-element lies, in the closed condition, coaxial with guide-rail 8. The lower and upper profiled rails lie coaxially behind the lower and upper guide-rails.

I claim:

1. A partition comprising a rounded entrance-area and two wall-elements, one of which is arranged at each side of said entrance-area;

at least one guide-rail comprising a curved middle portion extending across said entrance-area and straight end portions extending along said wall-elements;

a pair of door-elements, each door-element being curved to complementally match the curved middle portion of said guide-rail, for opening and closing said entrance-area;

a pair of outwardly extending guide elements mounted on each door-element for movably supporting the door-element on said guide-rail, said guide elements of each door-element being arranged at a predetermined distance from longitudinal edges of the door-element and being spaced apart a distance which is larger than, but less than 2 times as large as, said predetermined distance between one of said guide elements and the respective longitudinal edge of said door-element, and wherein roller elements associated with said guide elements are inclined in relation to a radial-plane extending through the guide elements, at a predetermined angle toward a central radial plane through each door element.

2. A partition according to claim 1, wherein said guide-rail is connected to said wall-elements; said door-elements each extend over an angular range of from 40° to 50°, and each of said wall-elements comprises a vertical side-profile, the two vertical side profiles of the wall-elements defining said entrance-area, each vertical side profile comprising a web against which a sealing element of an adjacent door-element bears.

3. A partition according to claim 2, wherein said sealing element overlaps said web from the rear side and projects with one arm between upper and lower guide rails.

4. A partition according to claim 3, wherein each of said door-elements has an upper and a lower profiled rail, and said upper profiled rail comprises an internal cavity and a longitudinal groove which is open toward said upper guide-rail, one of said guide elements comprising an arm extending out of said internal cavity through said longitudinal groove and having a guide roller mounted at the end thereof.

5. A partition according to claim 4, wherein the other of said guide-elements comprises an eccentrically mounted stud extending from said internal cavity through said longitudinal groove and having a guide roller mounted at the end thereof.

6. A partition according to claim 4, wherein said guide-elements are inserted longitudinally of said upper profiled rail into said cavity of said upper profiled rail and are secured therein by screw means.

7. A partition according to claim 1, wherein at least one of said guide-elements comprises an eccentric pin for adjusting the height of a door-element supported by it.

8. A partition according to claim 7, wherein said eccentric pin has an outer surface which comprises teeth, and wherein each of said door elements is curved over an angular range of 45° and has an upper and a lower profiled rail, said upper profiled rail being arranged coaxially with said guide-rail which is an upper guide-rail and said lower profiled rail being arranged coaxially with a lower guide-rail when said entrance opening is closed by said door elements, said upper and lower profiled rails being arranged, when looking from outside the partition, behind said upper and lower guide-rails, and wherein in said upper profiled rail there is provided an attachment-part comprising at least one locking arm which engages around said teeth of said eccentric pin, said upper profiled rail further comprising a bore in substantial alignment with the axis of said eccentric pin, said eccentric pin comprising a slot into which a tool may be inserted for varying the location of said eccentric pin inside said upper profiled-rail.

9. A partition according to claim 8, wherein said attachment part is connected to said upper profiled-rail by menas of a screw, said attachment part providing locking of said eccentric pin along said upper profiled-rail and also preventing said eccentric pin from rotating.

10. A partition according to claim 9, wherein said two door-elements extend over an angular range of about 45°, and wherein said distance between said guide-elements is larger, by a factor which is between 1.4 and 1.6, than said predetermined distances between said guide-elements and said longitudinal edges of said door-elements.

11. A partition according to claim 1, wherein said guide-rail is an upper guide-rail from which said door-elements are suspended, there being also provided a lower guide-rail.

12. A partition according to claim 11, wherein each of said door-elements has an upper and a lower profiled rail, and wherein looking from the outside of the partition, said profiled rails of the door-elements are arranged coaxially behind said guide-rails when said entrance area is closed by said door elements.

13. A partition according to claim 1, wherein said end portions of said guide-rail are straight areas and said wall-elements are stationary and flat, said straight areas of said guide-rail being secured to said stationary and flat wall-elements.

14. A partition according to claim 13, wherein only two door-elements are provided which are of the same width as said stationary wall-elements.

15. A partition according to claim 1, wherein each of the two door-elements is supported by a single fixed-height guide-element and a single guide-element which is adjustable in height.

16. A partition according to claim 15, wherein two sliding elements are arranged adjacent the bottom of each door-element each substantially vertically below one of said guide-elements.

17. A partition according to claim 1, wherein said predetermined angle is between 3° and 7°.

18. A partition according to claim 1, wherein said predetermined angle is approximately 5°.

19. A partition according to claim 1, wherein said guide-rail is an upper guide-rail and comprises two hollow rectangular portions and a central web which connects the two hollow rectangular portions together, the vertical overall height of said upper guide-rail being twice the horizontal width thereof.

* * * * *